United States Patent [19]

Javorik et al.

[11] Patent Number: 4,836,684

[45] Date of Patent: Jun. 6, 1989

[54] ULTRASONIC CLEANING APPARATUS WITH PHASE DIVERSIFIER

[75] Inventors: Laszlo J. Javorik, Oregon; Peter J. Puskas, Freeport, both of Ill.

[73] Assignee: Ultrasonic Power Corporation, Rockford, Ill.

[21] Appl. No.: 161,457

[22] Filed: Feb. 18, 1988

[51] Int. Cl.[4] ..... B08B 3/12; B01F 11/02

[52] U.S. Cl. ..... 366/114; 134/1; 134/184; 310/323; 310/335; 366/127

[58] Field of Search ..... 134/1, 184; 68/355; 366/111, 112, 114, 115, 127; 310/323, 335

[56] References Cited

U.S. PATENT DOCUMENTS

| | | | |
|---|---|---|---|
| 2,702,692 | 2/1955 | Kessler | 366/127 X |
| 3,254,284 | 5/1966 | Tomes . | |
| 3,371,233 | 2/1968 | Cook . | |
| 4,120,699 | 10/1978 | Kennedy, Jr. et al. . | |
| 4,554,477 | 11/1985 | Ratcliff . | |

*Primary Examiner*—Philip R. Coe

*Attorney, Agent, or Firm*—Leydig, Voit & Mayer

[57] ABSTRACT

A wedge-shaped vibration-transmitting plate is located between the bottom wall of a cleaning tank and an ultrasonic transducer which is operable to produce vibratory energy in a liquid bath in the tank. The wedge-shaped plate diversifies the phase of initially in-phase energy waves produced by the transducer and causes waves of different phase to propagate upwardly through the liquid. As a result of the phase diversification, the concentration of high and low power levels at various depths in the bath is reduced so that cleaning action over the span of the vertical dimension is more uniform. In addition, the overall action of wave reflection at the upper surface of the bath fluctuates through a smaller range when the depth of the bath changes. This enables the transducer to be energized with a more stable input power.

10 Claims, 1 Drawing Sheet

ULTRASONIC CLEANING APPARATUS WITH PHASE DIVERSIFIER

BACKGROUND OF THE INVENTION

This invention relates generally to cleaning apparatus and, more particularly, to apparatus in which parts in a bath of liquid are cleaned by virtue of vibrational wave energy causing the liquid to impinge on the parts to loosen sedimentation and surface contamination. The frequency of the vibrational wave energy usually is in the ulrasonic range although in some few cases the frequency may be in the lower sonic or audible range. Simply for purposes of brevity and convenience, the invention shall hereafter be described in this specification in conjunction with an ultrasonic system but, in the appended claims, the term "acoustic" should be considered to encompass both sonic and ultrasonic systems.

In conventional ultrasonic cleaning apparatus, the liquid bath for the parts is contained in a tank or the like. One or more electric-to-ultrasonic vibration transducers are mounted on a flat vibration-transmitting base or plate fixed to the lower side of the bottom wall of the tank. When the transducer means are electrically excited by an ultrasonic frequency oscillator, vibrational waves are produced and travel upwardly from the bottom of the tank to the top surface of the liquid. Upon reaching the top surface, the energy waves are, to some extent, reflected back into the bath.

If the transducer means produce waves of an essentially single and constant frequency, and assuming the transducer means are located at the bottom of the tank, a substantially uniform pattern of standing waves is set up in the liquid. As the depth of the liquid in the tank changes, wave reflection from the upper surface of the liquid will change in intensity but the pattern of the standing waves in the liquid will remain substantially uniform, that is, all standing waves will have essentially the same vertical locations of peaks and nulls. As a result, the peaks and nulls of the wave pattern occur at certain levels in the liquid and remain at those levels during the entire cleaning cycle, the peak amplitudes of the standing waves remaining essentially constant as long as the depth of the liquid is constant. This produces a non-uniform cleaning action along the height of a part disposed in the liquid. Moreover, the uniformity of efficiency of the cleaning action changes as the liquid level changes because the intensity of the energy refelcted back into the bath varies as the liquid depth changes over the span of a quarter wave length. Changes in liquid level changes the mechanical (and thus the overall) resonant frequency of the system and this results in significant variations in the output power of the ultrasonic generator and input power to the transducer means even though no change takes place in the output voltage of the frequency generator.

The problems created by a standing wave pattern at an essentially single chosen frequency have been recognized in the art of ultrasonic cleaning. Various solutions have been proposed. In this regard, reference is made to Tomes U.S. Pat. No. 3,254,284; Cook U.S. Pat. No. 3,371,233; Kennedy et al U.S. Pat. No. 4,120,699 and Ratcliff U.S. Pat. No. 4,554,477. Except for Kennedy et al, these solutions involve either exciting the bath with multile frequencies or sweeping the excitation frequency over a range as time passes, so that the bath contains vibrational waves of different wave lengths. In the case of Kennedy et al, a plurality of transducers are spaced around a tank in somewhat opposed configuration to one another so that opposed vibratory radiations create an interference pattern which breaks up the pronounced effect of single frequency standing waves. Multiple frequency or sweep frequency generators and transducers are significantly more complex and expensive than single frequency apparatus; and opposed transducers are likewise an expensive approach to the problem.

SUMMARY OF THE INVENTION

The general aim of the present invention is to provide new and improved ultrasonic cleaning apparatus which may be designed quite simply to operate essentially at a single frequency but in which peaks and nulls in the overall pattern of standing waves are closely spaced and spread homogeneously in a manner which is more simple, less expensive and more effective than has been possible heretofore.

Another important object of the invention is to provide such ultrasonic cleaning apparatus in which the degree of wave energy reflection from the upper surface of the liquid fluctuates only slightly, if at all, when the depth of the liquid changes. In consequence, the efficiency of conversion of electrical power fed to the transducer into total vibrational power within the liquid is held essentially uniform —even though not optimized—as the depth of the liquid varies, whereby depth changes do not cause significant variations in cleaning action on workpieces.

It is a further aim of the invention to increase the overall power output of the transducer means so that the average level of power output for variations in liquid level will be higher than is the case with prior apparatus of the same general type.

A more detailed object is to achieve the foregoing by differentially shifting the phase of single frequency vibrational energy waves transmitted from one or more ultrasonic transducers into a liquid bath so that the peaks and nulls of standing waves throughout the body of liquid are staggered relative to one another and no level in the liquid is at a permanent maximum or minimum of a standing wave.

In a still more detailed sense, the invention resides in transmitting ultrasonic energy from the transducer means to the liquid bath by way of a vibration-transmitting plate effective to cause energy waves which are of the same phase when initially produced at the face of the transducer to be of diverse phases as such waves pass through the liquid. In the preferred embodiment of the invention, the vibration-transmitting plate is in the shape of a wedge having a gradually changing thickness to cause the energy waves to be of different phases as they reach, and travel within, the bath of liquid in the tank.

DETAILED DESCRIPTION OF THE PREFERRED EMBODIMENT

Figure 1:
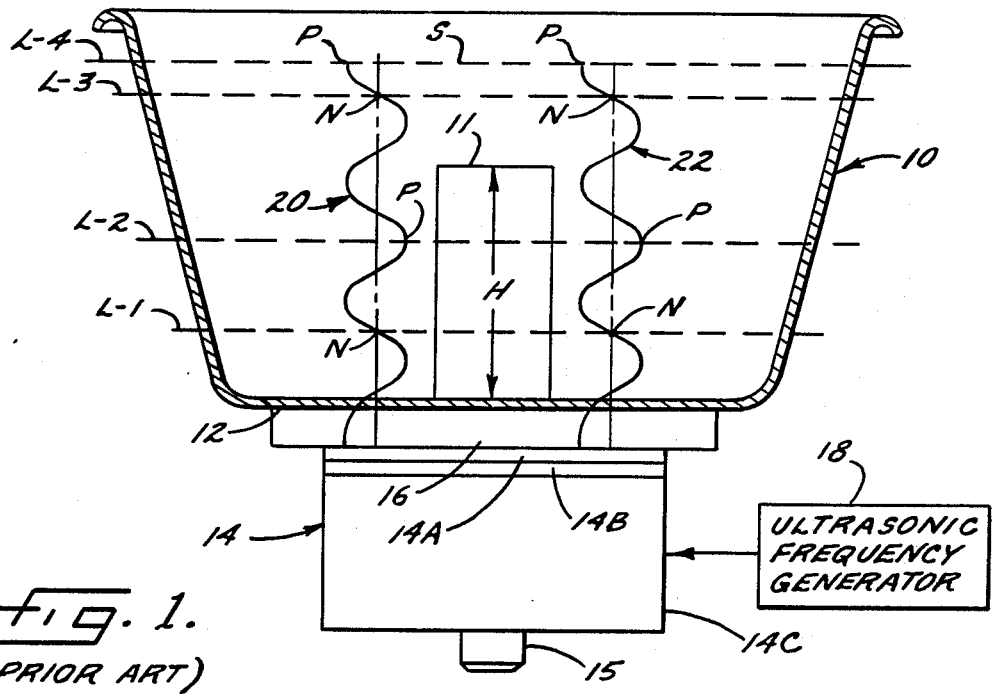
Fig. 1. (PRIOR ART)
FIG. 1 is a schematic view showing known and conventional single frequency ultrasonic cleaning apparatus of the type upon which the present invention improves.

To facilitate an understanding of the ultrasonic cleaning apparatus of the present invention, reference is first made to FIG. 1 which schematically shows a typical prior art cleaning apparatus upon which the present invention improves. As illustrated, the prior art apparatus includes a container 10 shown in the form of an open-topped tank made of metal such as stainless steel. The tank is partially filled with a bath of water or other liquid containing any desired detergent or additives and whose upper surface has been designated as S.

Parts to be cleaned are placed in the tank 10 and submerged in the water. For simplicity, a single part 11 of height H has been shown schematically as resting on the horizontal bottom wall 12.

To clean the part 11, vibrational wave energy is directed into and through the water to produce compressional vibrations. In consequence, the water beats on the surface of the part, with or without cavitation, and thereby loosens and removes dirt or other foreign matter. While the wave energy could be at an audible or sonic frequency, more efficient cleaning is effected when the frequency of the wave energy is ultrasonic.

To produce the ultrasonic wave energy, transducer means are located beneath the bottom wall 12 of the tank 10. In this instance, the transducer means comprise an electric-to-ultrasonic vibration transducer 14 of a conventional and known type. The transducer 14 includes a dominant mode single frequency piezoelectric crystal 14A although magnetostrictive elements also may be used. The transducer is energized or excited by an electronic frequency generator or oscillator 18 which excites the crystal with ac. voltage (essentially sinusoidal) at a substantially constant and single frequency. Thus, the system is basically a single frequency system in which essentially constant and single frequency vibrations are applied to the liquid by the transducer. While a single transducer has been shown for the sake of simplicity, two or more transducers may be located beneath the tank or on one or more sides of the tank.

The transducer 14 is fixed to the lower side of a horizontal vibration-transmitting base or plate 16 which, in turn, is fixed to the horizontal lower side of the bottom wall 12 of the tank 10. Conventionally, the plate 16 is made of a metal such as aluminum and has a uniform thickness in the neighborhood of ⅜". The upper energy-radiating end or crystal 14A of the transducer 14 is in intimate face-to-face contact with the lower side of the plate 16 while the upper side of the plate is bonded in face-to-face contact with the lower side of the bottom wall 12.

The transducer 14 is completed by ceramic insulator 14B beneath the crystal 14A and by a backing member 14C beneath the insulator. A screw 15 secures the transducer to the plate 16.

Standing waves 20 and 22 shown in FIG. 1 symbolically represent the composite vibrational wave energy produced by the transducer 14 and applied to the liquid bath. As is apparent from FIG. 1, the two standing waves 20 and 22 are in phase with one another. In actuality, the transducer 14 produces a virtually infinite number of standing waves, each and all of which are represented by the waves 20 and 22. Since all of these standing waves are produced by traveling vibrational waves which are of the same single frequency and which travel the same distances through the metal of the plate 16 and the liquid, all of such standing waves are in phase with one another.

One disadvantage inherent in conventional single frequency ultrasonic cleaning systems arises from the fact that such a system produces peaks and nulls on the standing waves separated by equal distances, corresponding to a quarter wave length, vertically through the liquid. The power level is high (maximum) at a peak and low (minimum) at a null, so cleaning action on the part is non-uniform. Indeed, strips of very clean regions and poorly cleaned regions may often be seen on a part subjected to a given cleaning procedure. In a conventional single frequency system, the peaks and nulls of substantially all of the standing waves occur at certain depth levels in the tank and remain in those levels during the entire cleaning cycle. This is illustrated in FIG. 1 where it can be seen that the nulls N or minimum power levels of the two representative waves 20 and 22 occur at the same liquid level, namely, level L-1. Similarly, the peaks P or maximum power levels of the two standing waves all occur at the same liquid level as indicated, for example, by the peaks P located at liquid level L-2. Accordingly, at a given depth in the liquid where a portion of a part to be cleaned is located, the cleaning action will be high or low depending upon whether the standing wave pattern is near its maximum or near its minimum at that particular depth. This variation in power density results in non-uniform cleaning action across the height H of a part disposed in the liquid bath.

Another disadvantage in conventional single frequency ultrasonic cleaning systems involves the reflection of wave energy back into the liquid from the atmosphere located at the surface S of the liquid. Good reflection returns energy to the bath, rather than permitting it to escape, and thus creates better efficiency for the conversion of electrical energy into useful vibrational energy within the bath. When the vibrational energy waves, and thus also the resulting standing waves, are in phase, the energy reflected back to the liquid varies widely as the depth of the water changes. Assume, for example, that the water surface S is at level L-4 as indicated in FIG. 1. Assume further that maximum energy is reflected when the peaks of the standing waves are at the surface S and that minimum energy is reflected when the nulls of such waves are at the surface. In FIG. 1, the peaks of the in-phase standing waves have been shown as being at the surface when the surface is at level L-4 and, as a result, maximum energy is reflected. If, however, the surface S of the water resides at level L-3, the nulls of all waves are at the surface and this results in reflection of minimum energy. Such wide swings between the maximum and minimum levels of the reflected energy cause the useful output power (that is, liquid vibration power) derived from the frequency generator 18 to fluctuate over a wide range. As a result, there can be significant variations in the efficiency of the cleaning action depending upon the depth of the liquid.

In accordance with the present invention, the drawbacks described above are alleviated in a comparatively simple, inexpensive and trouble-free manner through the provision of means 26 (FIG. 2) uniquely located between the transducer and the liquid bath and effective to cause vibrational waves which are of the same phase when initially produced by the transducer to be of diverse phases as they enter and travel through the liquid bath. As a result of the phase diversification, the striations of high and low power levels at different fixed depth levels in the bath are broken up. Because a virtually infinite quantity of standing waves then exist in the liquid, with all such standing waves shifted slightly in phase relative to one another, the peaks and nulls of power are, so to speak, spread homogeneously through the liquid in a vertical direction. In addition and due to the multiplicity of phases (that is, differing amplitudes) with which those several waves reach the surface S, the wide swings in the intensity of reflected energy at various water depths are attenuated. That is, the average effectiveness of reflection remains essentially the same as liquid level changes.

Figure 2:
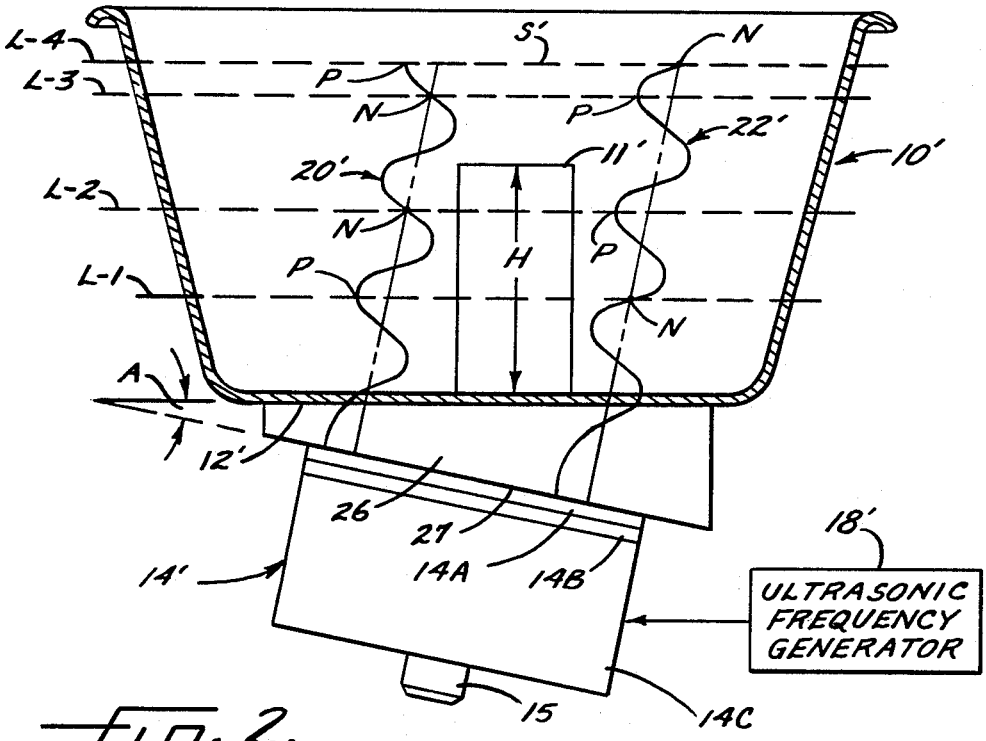
FIG. 2 is a schematic view of new and improved ultrasonic cleaning apparatus incorporating the unique features of the present invention.

In this particular instance, the means 26 comprise a vibration-transmitting plate of special character located between the transducer and the bottom wall of the tank. The cleaning apparatus of the invention as shown in FIG. 2 is identical to the prior art cleaning apparatus as shown in FIG. 1, except for the differences between the vibration-transmitting plate 16 of FIG. 1 and the vibration-transmitting plate 26 of FIG. 2. Accordingly, components in FIG. 2 identical to those of FIG. 1 have been indicated by the same but primed reference numerals.

More specifically, the vibration-transmitting plate 26 is made of a suitable material (such as aluminum) and includes a flat upper side which is disposed in a horizontal plane and in face-to-face contact with the horizontal underside of the bottom wall 12' of the tank 10'. The plate usually is bonded in intimate contact with the bottom wall.

Pursuant to the invention, different portions of the plate 26 are of different thicknesses. In the preferred embodiment, this is achieved by making the plate generally wedge-shaped so that its lower side 27 is disposed in a plane which is inclined at an angle A relative to the horizontal plane occupied by the upper side of the plate. The transducer 14' is located with its central axis disposed perpendicular to the lower side 27 of the plate 26 and with its upper radiating end in intimate face-to-face contact with the lower side of the plate.

Vibratory energy propagates through water at a velocity of 57,528 in./sec. and propagates through aluminum at a mcuh higher rate of 200,880 in./sec. Neglecting the effects of the bottom wall of the tank, the angle of phase shift $\phi$ between a sinusoidal vibration at the upper face of the transducer and a resulting sinusoidal vibration at a distance d measured upwardly from the bottom of the liquid is equal to the sum of (1) the angle of phase shift occurring between the bottom and top surfaces of the aluminum plate 16 or 26 and (2) the angle of phase shift occurring within the bath due to propagation through the distance d. This may be expressed:

$$\phi = 2\pi f\left(\frac{t}{v} + \frac{d}{V}\right) \quad (1)$$

where f is the frequency of the vibration, t is the thickness of the aluminum, v is the velocity of propagation in aluminum, d is the distance through the water from the bottom of the tank up to any vertical location being considered, and V is the propagation velocity in water.

From the above, it is apparent that the total angle of phase shift $\phi$ between (1) a sinusoid existing at the transducer and (2) in a sinusoid at any point located at the distance d varies directly as a function of both the thickness t of the aluminum and the distance d. In the case of the conventional prior art system (FIG. 1) where the aluminum vibration-transmitting plate 16 has a uniform thickness t, the angles of phase shift of all vibrational waves entering the bottom of the water are identical and thus all waves are in phase as they propagate upwardly through the water and are all equally shifted in phase during such propagation. It is this phenomenon which causes corresponding nulls N of all standing waves (e.g., waves represented by the waves 20 and 22 of FIG. 1) in the prior art system to occur at the same liquid levels (e.g., the level L-1) and causes corresponding peaks P of all waves to occur at levels (e.g., the level L-2) displaced by one-quarter wavelength from the levels of the nulls. This symmetry in the standing wave pattern results in certain areas along the height H of the part 11 being subjected to minimum power levels while other areas are subjected to maximum power levels. Accordingly, the "uniformity" of the standing wave patterns results in non-uniform cleaning action at levels spaced along the height of the part 11.

In the cleaning system of the invention (FIG. 2), however, the thickness t of the wedge-shaped vibration-transmitting plate 26 varies linearly (increases at locations taken left-to-right) along the energy-radiating end of the transducer 14'. As a result, there is a virtually infinitesimally small change in the angle of phase shift between adjacent vibrational waves propagating through different thicknesses of the aluminum plate 26 and passing into the bottom of the water. Thus, waves which are of the same phase when initially entering the lower side 27 of the plate 26 are of different phase when they exit the upper side of the plate and enter the water. The result of this is illustrated schematically by the two standing waves designated 20' and 22' in FIG. 2. That is, the standing wave at 20' results from vibrational waves transmitted through the thin portion of the plate 26, whereas the standing wave at 22' results from vibrational waves transmitted through the thicker portion. The standing wave represented at 20' schematically depicts one end (minimum phase shift) of the phase spread between vibrational waves while the standing wave represented at 22' depicts the opposite end of the phase spread. One sees that the two standing waves are not aligned; on the contrary, there is in effect a phase shift between the standing waves. Preferably, and in a manner which will be described subsequently, there is a 90° or one-quarter wavelength phase difference between the waves 20' and 22'.

With further reference to FIG. 2, it will be seen that, at depth level L-1, the standing wave 20' is at a peak P while the standing wave 22' is at a null N. And, at level L-2, the wave 20' is at a null N while the wave 22' is at a peak P. Remembering that the illustrated standing waves 20' and 22' represent many standing waves of specifically different relative phases over a given spread, it will be understood that at either one (indeed, at both) of those levels L-1 or L-2; the intensity of the vibration energy (i.e., the power) is determined by the sum of the magnitudes of a whole series of standing waves at different individual relative phases. At a given height on the part 11', some of the existing standing waves will have a peak, some a null, and many will have magnitudes that are different fractions of the peak. Thus, each vertical location on the part will be subjected to essentially the same intensity of cleaning action, and the striations mentioned above will be eliminated. This means that the uniformity of cleaning of the part 11 along its height 11 is enhanced in the cleaning system of the invention because no point in the liquid is at a maximum or minimum on all of the standing waves, as in the case of FIG. 1.

As stated above, a 90° phase spread is preferable between the maximum and minimum phase shift. Such a spread is effected by properly graduating the thickness t of the vibration-transmitting plate 26 according to the material of the plate and the frequency f at which the transducer 14' is excited. Assuming, for example, that the plate 26 is aluminum and the transducer 14' is excited at a frequency of 40 kHz, the wavelength L of the energy propagating through the plate is about 5.022" and may be calculated by the formula:

$$L = \frac{v}{f} = \frac{200{,}880}{40{,}000} = 5.022 \qquad (2)$$

A phase shift of 90° occurs in the sinusoidal vibration as it travels through a distance equal to one-quarter wavelength, i.e., 5.022"/4 or about 1.255". Thus, if the wedge-shaped plate is made, for example, 0.25" thick at its left edge and 0.25"+1.255"=1.505" thick at its right edge, the spread or range of phase shifts for the infinite quantity of transmitted waves will be over a span of 90°. Of course, a phase shift spread of either greater or less than 90° may be chosen. But 90° provides the theoretical maximum of phase deversification, and more than 90° produces no theoretical benefit since $|\sin\theta| = |\sin(180° - \theta)|$.

Because there is a 90° phase shift across the spectrum of standing wave power in the water of the cleaning system of FIG. 2, changes in the level of the surface S' result in less total variance in the degree of the wave energy reflected back into the bath at the surface S'. When, for example, the surface S' is at level L-4 shown in FIG. 2, the standing wave 20' exhibits a peak while the wave 22' exhibits a null just at that surface. If the surface S' is at level L-3, the standing waves 20' and 22' have a null and a peak, respectively, at the surface S'. All other standing waves in the continuum of those which are relatively shifted in phase by angles between 0° and 90° will reach the surface with a magnitude between maximum and minimum and will be reflected with corresponding intensity. As water level changes, the surface S' will move closer toward peaks of some of those standing waves, but further from the peaks of other waves—with the result that the average of all the reflection action of the total energy will remain essentially the same. Accordingly, the variance in initial reflection of energy as a function of changes in water depth are less than is the case of the prior art system of FIG. 1 where the total reflected energy can change from a maximum to a minimum if the water level changes by 0.360", which is a distance equal to one-quarter wavelength of energy propagating through water at a frequency of 40 kHz. Because there is less variance in reflected energy in the system of FIG. 2, the so-called "impedance match" to the frequency generator 18' remains more uniform, the "loading" on the generator remains more constant, and the integral of the vibrational power at all points in the liquid bath stays essentially the same, so that cleaning efficiency and uniformity are affected less when the depth of the water changes. Tests comparing systems of the same general type as shown in FIGS. 1 and 2 have demonstrated that the power output of (loading on) the frequency generator 18 of the system of FIG. 1 ranged from a minimum of 95 watts to a maximum of 173 watts, while the power output of the frequency generator 18' of the system of of FIG. 2 ranged from a minimum of 200 watts to a maximum of 242 watts, due to changes in water depth. This resulted in the system of FIG. 2 enjoying an 11 percent improvement in efficiency, a 65 percent improvement in power integral, an 86 percent improvement in power factor, and improvement by a factor of 4 in minimum/-maximum power output uniformity.

While the invention has been specifically shown and described in connection with a wedge-shaped vibration-transmitting plate 26 whose thickness changes linearly along its length, those familiar with the art will appreciate that other means may be provided between the transducer means 14' and the bath of liquid to diversify the phase of initially in-phase vibrational waves emitted by the transducer. The plate 26, for example, may take different shapes. Alternatively, it may be made of uniform physical thickness (so as to appear physically like plate 16 in FIG. 1) but of a non-homogeneous material which is graduated so as to present gradually changed velocities of propagation. Indeed, the plate may be eliminated altogether and the bottom wall 12' of the tank 10' may be shaped or constructed as necessary to produce appropriate phase diversification. If multiple transducers are employed, a plate of stepped configuration may be used to produce a phase shift from transducer-to-transducer while permitting the transducers to be mounted perpendicular to the bottom wall of the tank.

From the foregoing, it will be apparent that the present invention brings to the art new and improved ultrasonic cleaning apparatus in which the plate 26 of simple mechanical construction effects a phase shift in the vibrational energy. As a result of the plate, the transducer 14' and the ultrasonic generator 18' may be of the standard single-frequency type and yet the problems created by a uniform standing wave pattern are eliminated.

We claim:

1. Apparatus comprising a container for holding a bath of liquid, a transducer located in atmosphere adjacent the outer side of said container and operable when energized to produce vibrational energy waves which are transmitted through said container and into said bath, and means located between said transducer and said bath for causing energy waves which are of the same phase when initially produced to be of diverse phases as such waves pass into said bath, different portions of said means having different physical characteristics.

2. Apparatus as defined in claim 1 in which said means comprise a vibration-transmitting plate between said container and said transducer, different portions of said plate being of different thicknesses.

3. Cleaning apparatus comprising a container for holding a bath of liquid, said container having a wall with an outer side, a vibration-transmitting plate having one side adjacent said outer side of said wall, transducer means located in atmosphere adjacent the opposite side of said plate and operable when energized to produce vibrational energy waves which are transmitted through different portions of said plate and said wall and into said liquid, said different portions of said plate having different physical characteristics and causing energy waves which are of the same phase when initially produced to be of diverse phases as such waves pass into said liquid.

4. Cleaning apparatus as defined in claim 3 in which said different portions of said plate are of different thicknesses.

5. Cleaning apparatus as defined in claim 3 in which said outer side of said wall and said one side of said plate are disposed in a generally horizontal plane, said opposite side of said plate being disposed in a plane which is obliquely inclined relative to said horizontal plane.

6. Cleaning apparatus as defined in claim 3 in which the energy waves produced by said transducer means are all of substantially single and constant frequency.

7. Acoustic cleaning apparatus comprising a container for holding a bath of liquid, said container having a wall with an outer side disposed in a predetermined plane, a vibration-transmitting plate located in atmosphere having one side disposed in face-to-face contact with the outer side of said wall, electric-to-acoustic transducer means attached to the opposite side of said plate and operable when energized to produce vibrational energy waves which are transmitted through said plate and said wall and into said liquid, said transducer means also being located in atmosphere, said opposite side of said plate being disposed in a plane which is obliquely inclined relative to the plane of the outer side of said wall so as to cause the energy waves produced by said transducer means to be shifted in phase relative to one another as said waves enter said liquid.

8. Acoustic cleaning apparatus as defined in claim 7 in which said wall defines the bottom of said container, said outer side of said wall and said one side of said plate being in a horizontal plane, said plate being generally wedge-shaped.

9. Ultrasonic cleaning apparatus as defined in claim 7 in which the energy waves produced by said transducer means are all of substantially single and constant frequency.

10. Ultrasonic cleaning apparatus comprising a container for holding a bath of liquid, said container having a bottom wall with a lower side disposed in a substantially horizontal plane, a vibration-transmitting plate located in atmosphere having an upper side disposed in face-to-face contact with the lower side of said bottom wall, electric-to-ultrasonic transducer means attached to the lower side of said plate in face-to-face contact with said plate and located in atmosphere, said transducer means being operable when energized to produce substantially single and constant frequency vibrational energy waves which are transmitted through said plate and said wall and into said liquid, said plate being generally wedge-shaped so as to cause said energy waves to be out of phase with one another as said waves enter and therefore as they pass through said liquid.

* * * * *